US011794325B2

(12) United States Patent
Inagaki et al.

(10) Patent No.: US 11,794,325 B2
(45) Date of Patent: Oct. 24, 2023

(54) POWER TOOL HAVING ROTARY HAMMER MECHANISM

(71) Applicant: MAKITA CORPORATION, Anjo (JP)

(72) Inventors: Naoki Inagaki, Anjo (JP); Yoshitaka Machida, Anjo (JP); Hiroki Kaneko, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/672,999

(22) Filed: Feb. 16, 2022

(65) Prior Publication Data

US 2022/0281092 A1 Sep. 8, 2022

(30) Foreign Application Priority Data

Mar. 3, 2021 (JP) ..... 2021-033906

(51) Int. Cl.

| | |
|---|---|
| ***B25D 17/06*** | (2006.01) |
| ***B25D 11/00*** | (2006.01) |
| ***B25D 16/00*** | (2006.01) |
| ***B25D 17/08*** | (2006.01) |

(52) U.S. Cl.

CPC ..... *B25D 17/06* (2013.01); *B25D 11/00* (2013.01); *B25D 16/00* (2013.01); *B25D 17/08* (2013.01)

(58) Field of Classification Search

None

See application file for complete search history.

(56) References Cited

U.S. PATENT DOCUMENTS

| | | | | |
|---|---|---|---|---|
| 3,203,490 | A * | 8/1965 | Short | B25D 16/00 173/117 |
| 2010/0000751 | A1* | 1/2010 | Aoki | B25D 17/24 173/114 |
| 2011/0290517 | A1* | 12/2011 | Takeuchi | B25D 17/00 173/90 |
| 2013/0014968 | A1* | 1/2013 | Kehoe | B23D 49/11 29/428 |
| 2013/0319712 | A1* | 12/2013 | Massler | B25D 11/06 173/201 |
| 2015/0197002 | A1* | 7/2015 | Didier | B25D 17/088 173/109 |
| 2016/0303727 | A1* | 10/2016 | Meixner | B23K 1/0008 |
| 2020/0254599 | A1* | 8/2020 | Paulsen | B25D 1/04 |

FOREIGN PATENT DOCUMENTS

| | | |
|---|---|---|
| EP | 2 883 663 A1 | 6/2015 |
| JP | 2011-251388 A | 12/2011 |

* cited by examiner

*Primary Examiner* — Tanzim Imam
(74) *Attorney, Agent, or Firm* — Oliff PLC

(57) ABSTRACT

A power tool having a rotary hammer mechanism is configured to produce hammering motion for driving a tool accessory along a driving axis and rotating motion for rotating the tool accessory around the driving axis. The power tool has a tool holder that is configured to removably hold the tool accessory. The tool holder has a rotation transmitting part configured to transmit rotating power to the tool accessory. A layer formed of carbide of a group 5 element of a periodic table is formed on the rotation transmitting part.

14 Claims, 8 Drawing Sheets

POWER TOOL HAVING ROTARY HAMMER MECHANISM

CROSS REFERENCE TO RELATED ART

The present application claims priority to Japanese Patent Application No. 2021-33906 filed on Mar. 3, 2021, the disclosure of which is hereby incorporated by reference in its entirety.

TECHNICAL FIELD

The present disclosure relates to a power tool having a rotary hammer mechanism.

BACKGROUND

As an example of a power tool capable of applying striking force (impact) on a workpiece, Japanese Unexamined Patent Application Publication No. 2011-251388 discloses a power tool that includes a cylinder disposed within a tool body and a hammer disposed in the cylinder so as to be movable within the cylinder. This power tool reciprocates the hammer within the cylinder and collides the hammer with an impact transmission body by press injecting fluid into the cylinder and discharging the fluid, to thereby provide striking force.

SUMMARY

In JP2011-251388A described above, a coating layer is formed on the surface of the hammer within the cylinder to prevent the hammer from cracking. Recently, however, a technique for enhancing durability has been desired in a power tool having a rotary hammer mechanism that is capable of transmitting not only the striking force but also rotating power to a tool accessory.

According to one aspect of the present disclosure, a power tool having a rotary hammer mechanism is provided. The power tool is configured to produce hammering motion for driving a tool accessory along a driving axis and rotating motion for rotating the tool accessory around the driving axis. The power tool has a tool holder configured to removably hold the tool accessory. The tool holder has a rotation transmitting part configured to transmit rotating power to the tool accessory. A layer of carbide of a group 5 element of a periodic table is formed on the rotation transmitting part.

According to this aspect, the carbide layer of the group 5 element of the periodic table, can suppress wear of the rotation transmitting part that may be caused by transmitting the rotating power to the tool accessory. Accordingly, the durability of the tool holder can be enhanced and thus the durability of the rotary power tool can also be enhanced.

DETAILED DESCRIPTION OF THE EMBODIMENTS

Figure 1:
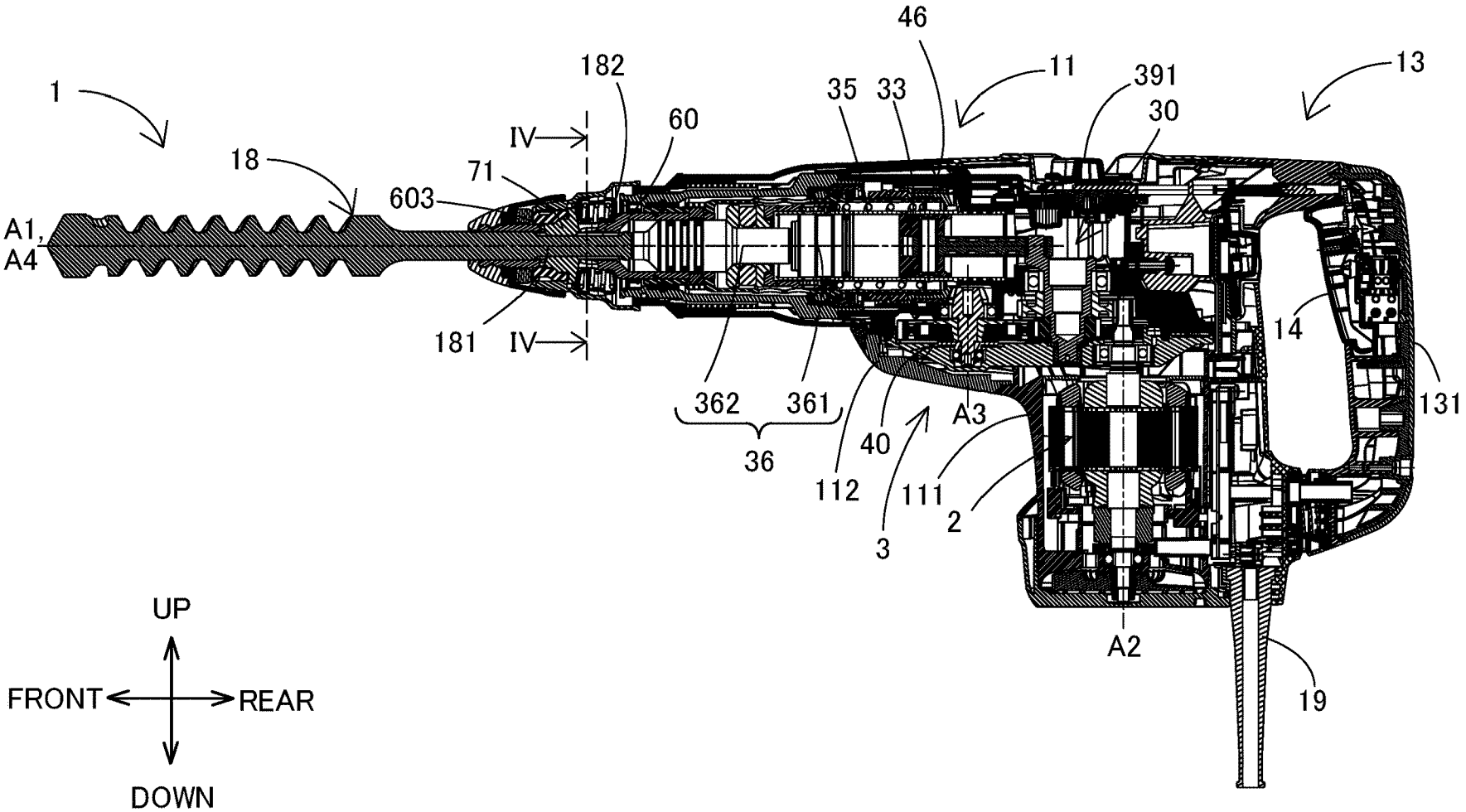
FIG. 1 is a sectional view of a rotary hammer 1 with a tool accessory 18 attached thereto.

In one non-limiting embodiment according to the present disclosure, the layer may be a vanadium carbide (VC) layer.

With the above-described configuration, a vanadium carbide layer formed on the rotation transmitting part of the tool holder can effectively suppress wear of the rotation transmitting part. Thus, the durability of the tool holder can be enhanced.

In addition or in the alternative to the preceding embodiments, the tool holder may be a forged product.

With the above-described configuration, the degree of freedom in shape of the tool holder can be enhanced.

In addition or in the alternative to the preceding embodiments, the tool holder may have a tubular wall configured to hold the tool accessory. The rotation transmitting part may be formed as a plurality of protruding parts (projections) protruding radially inward from an inner peripheral surface of the tubular wall.

With the above-described configuration, wear of the protruding parts can be suppressed while rotating power is transmitted to the tool accessory by the protruding parts protruding radially inward from the inner peripheral surface of the tubular wall.

In addition or in the alternative to the preceding embodiments, the power tool may have a striking (hammering, impacting) element configured to transmit striking force (impact) to the tool accessory by moving along the driving axis and colliding with the tool accessory. The tool holder may have a tubular wall that is configured to hold the tool accessory and at least a portion of the striking element.

With the above-described configuration, the tool holder is provided with not only a function of holding (housing) the tool accessory but a function of holding (housing) the striking element. Thus, the parts count (the number of parts/components) of the power tool can be reduced as compared with a configuration in which a member for housing the striking element is separately provided.

In addition or in the alternative to the preceding embodiments, the power tool may have a piston configured to move the striking element along the driving axis. The tubular wall may be configured to at least partly house the piston on a side opposite to the tool accessory on the driving axis.

With the above-described configuration, the tool holder is further provided with a function of housing at least part of the piston. Thus, the parts count of the power tool can be reduced as compared with a configuration in which a member for housing the piston is separately provided.

In addition or in the alternative to the preceding embodiments, an inner peripheral surface of a portion of the tubular wall that houses the striking element (i.e., a housing portion for the striking element) may have a lower surface roughness than surfaces of the remaining portions of the tubular wall.

With the above-described configuration, air tightness between the striking element and the tubular wall can be enhanced.

In addition or in the alternative to the preceding embodiments, the tool holder may be made of steel containing carbon of not less than 0.04 mass % and not greater than 0.25 mass %.

With the above-described configuration, the tool holder can be provided which is suitable for transmitting rotating power to the tool accessory.

In addition or in the alternative to the preceding embodiments, the power tool may have a motor configured to generate the rotating power. A rotational axis of the motor may cross the driving axis.

With the above-described configuration, the power tool is provided in which the rotational axis of the motor is arranged to cross the driving axis.

In addition or in the alternative to the preceding embodiments, the power tool may have a motor configured to generate the rotating power. A rotational axis of the motor may be parallel to the driving axis.

With the above-described configuration, the power tool is provided in which the rotational axis of the motor is arranged in parallel to the driving axis.

First Embodiment

Figure 2:
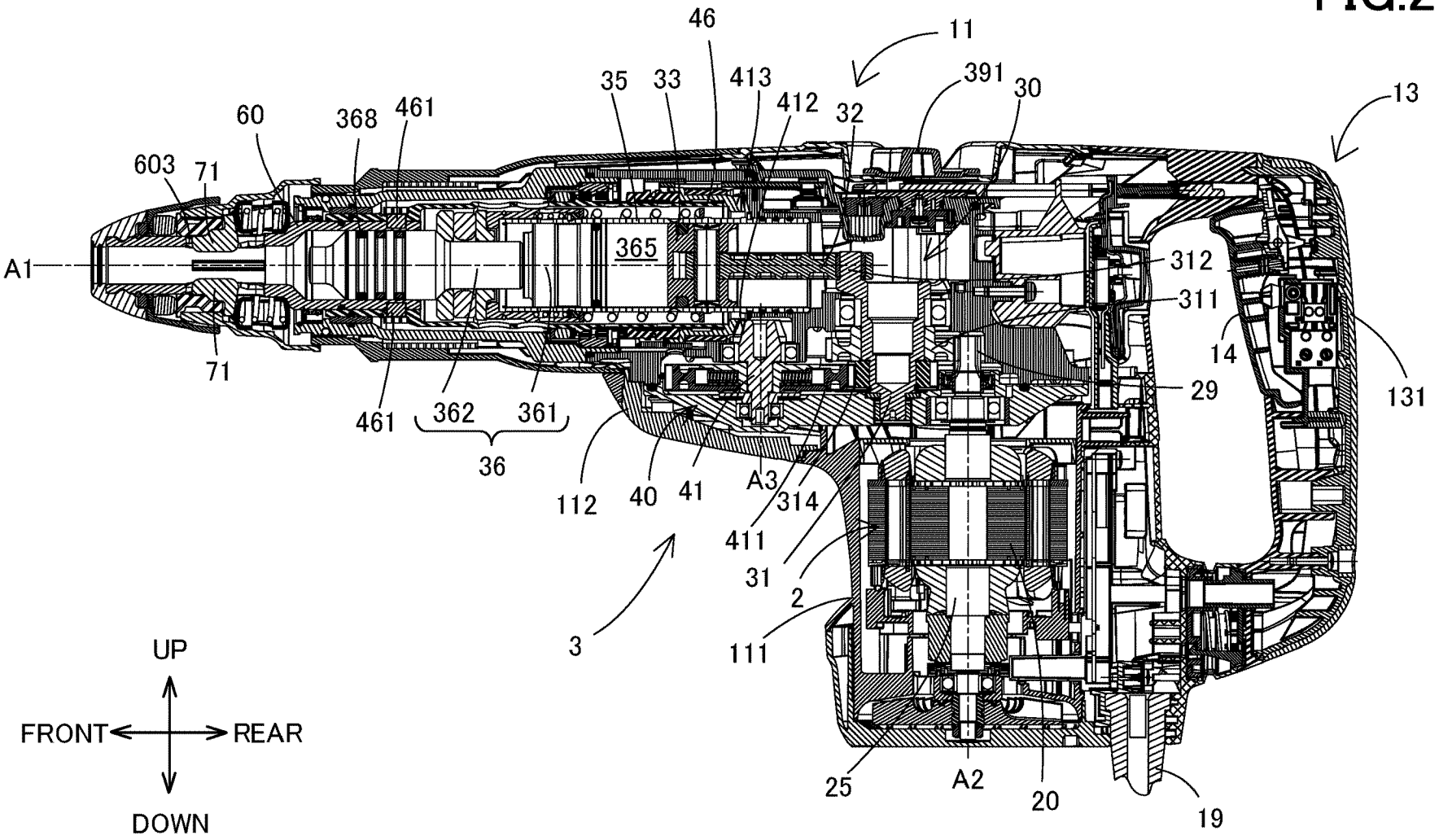
FIG. 2 is a sectional view for illustrating the structures of elements disposed within the rotary hammer 1.

A power tool having a rotary hammer mechanism according to a first embodiment is now described with reference to FIGS. 1 to 4. FIGS. 1 and 2 show a rotary hammer (also called a hammer drill) 1 as a representative example of the power tool having a rotary hammer mechanism. The rotary hammer 1 is configured to produce (provide) hammering motion and rotating motion. The hammering motion is to linearly drive the tool accessory 18 along a driving axis A1, and the rotating motion is to rotationally drive the tool accessory 18 around the driving axis A1. The driving axis A1 is also referred to as a hammering axis (striking axis, impact axis).

First, the structure of the rotary hammer 1 is described in brief with reference to FIGS. 1 and 2. An outer shell of the rotary hammer 1 is mainly formed by a body housing 11 and a handle 13 that is connected to the body housing 11.

The body housing 11 includes a driving-mechanism housing part 112 that houses a driving mechanism (rotary hammer mechanism) 3, and a motor housing part 111 that houses a motor 2. The driving-mechanism housing part 112 has an elongate shape extending in a direction of the driving axis A1, and the motor housing part 111 is arranged to protrude in a direction away from the driving axis A1. Thus, the body housing 11 is generally L-shaped as a whole. A tool holder 60 is provided within one end portion of the driving-mechanism housing part 112 in the driving axis A1 direction and configured to removably hold the tool accessory 18. In this embodiment, a rotational axis A2 of a motor shaft 25 extends in a direction orthogonal to the driving axis A1.

In the following description, for convenience sake, the extending direction of the driving axis A1 (the driving axis A1 direction) is defined as a front-rear direction of the rotary hammer 1. In the front-rear direction, the side of one end portion of the rotary hammer 1 in which the tool holder 60 is provided is defined as the front of the rotary hammer 1 and the opposite side is defined as the rear of the rotary hammer 1. The extending direction of the rotational axis A2 of the motor shaft 25 is defined as an up-down direction of the rotary hammer 1. In the up-down direction, the side of the rotary hammer 1 to which the motor housing part 111 protrudes from the driving-mechanism housing part 112 is defined as a lower side, and the opposite side is defined as an upper side.

Detailed structures of rotary hammer 1 are now described.

The handle 13 is connected to a rear end portion of the body housing 11. The handle 13 has a grip part 131 extending in a direction crossing the driving axis A1. The handle 13 is generally U-shaped as a whole. A trigger 14 is provided in a front portion of the grip part 131 and configured to be manually depressed by a user to drive the motor 2.

The motor housing part 111 of the body housing 11 houses the motor 2 as described above. As shown in FIG. 2, the motor 2 has a motor body 20 including a stator and a rotor, and a motor shaft 25 extending from the rotor. In this embodiment, an AC motor is adopted as the motor 2 that is driven by power supply from an external power source via a power cable 19. Lower and upper end portions of the motor shaft 25 are rotatably supported by bearings held by the motor housing part 111. A driving gear 29 is on an upper end portion of the motor shaft 25.

The driving-mechanism housing part 112 of the body housing 11 houses the driving mechanism 3 as described above. The driving-mechanism housing part 112 has a generally cylindrical front portion extending along the driving axis A1. The tool holder 60 is housed in this front portion. The tool holder 60 of this embodiment has a hard coating layer (film) and thus has excellent wear resistance. The tool holder 60 will be described in detail below.

In this embodiment, the driving mechanism 3 includes a motion converting mechanism 30, a striking mechanism (hammering mechanism) 36 and a rotation transmitting mechanism 40.

The motion converting mechanism 30 is configured to convert rotation of the motor shaft 25 into linear motion and transmit it to the striking mechanism 36. In this embodiment, the motion converting mechanism 30 is configured as a crank mechanism, and includes a crank shaft 31, a connecting rod 32 and a piston 33. The crank shaft 31 is arranged in parallel to the motor shaft 25 in front of the motor shaft 25 in a rear end portion of the driving-mechanism housing part 112. The crank shaft 31 has a driven gear 311 provided on its lower portion and engaged with a driving gear 29, and a crank pin 312 provided on its upper end portion. One end portion of the connecting rod 32 is rotatably connected to the crank pin 312, while the other end portion of the connecting rod 32 is connected to the piston 33 via a pin. The piston 33 is slidably disposed within a cylinder 35. When the motor 2 is driven, the piston 33 is reciprocated along the driving axis A1 in the front-rear direction within the cylinder 35. In this embodiment, the cylinder 35 is housed within a sleeve 46. The sleeve 46 is supported by the body housing 11 so as to be rotatable around the driving axis A1 relative to the body housing 11. A rear end portion of the tool holder 60 is fitted into the sleeve 46.

The striking mechanism 36 includes a striker 361 and an impact bolt 362. The striker 361 is disposed in front of the piston 33 so as to be slidable along the driving axis A1 in the front-rear direction within the cylinder 35. An air chamber 365 is formed between the striker 361 and the piston 33. The striker 361 is linearly moved in response to air pressure fluctuations in the air chamber 365 that is caused by reciprocating movement of the piston 33. The impact bolt 362 is disposed in front of the striker 361. The impact bolt 362 is configured to transmit kinetic energy of the striker 361 to the tool accessory 18. In this embodiment, the tool holder 60 has a tubular shape, and the impact bolt 362 is slidably arranged inside of a tubular wall 601 of the tool holder 60. An annular elastic member 368 (so-called O-ring) is disposed between the impact bolt 362 and the tool holder 60. In this embodiment, the elastic member 368 is fitted in an annular groove formed in an outer peripheral surface of the impact bolt 362.

When the motor 2 is driven and the piston 33 is moved forward, air in the air chamber 365 is compressed and its internal pressure increases. The striker 361 is pushed forward at high speed by action of the air spring and collides with the impact bolt 362, thereby transmitting its kinetic energy to the tool accessory 18. As a result, the tool accessory 18 is linearly driven along the driving axis A1 and strikes a workpiece. On the other hand, when the piston 33 is moved rearward, air of the air chamber 365 expands so that the internal pressure decreases and the striker 361 is retracted rearward. The rotary hammer 1 produces (provides) hammering motion by causing the motion converting mechanism 30 and the striking mechanism 36 to repeat these operations.

The rotation transmitting mechanism 40 is configured to transmit torque of the motor shaft 25 to the tool holder 60. In this embodiment, the rotation transmitting mechanism 40 is configured as a reduction gear mechanism including a plurality of gears. The gears of the rotation transmitting mechanism 40 include a driving gear 29, a driven gear 311, a first gear 314, a second gear 411, a small bevel gear 412 and a large bevel gear 413. The driven gear 311 and the first gear 314 are provided on the crank shaft 31. The second gear 411 and the small bevel gear 412 are provided on an intermediate shaft 41. The large bevel gear 413 is provided on the sleeve 46.

The intermediate shaft 41 is arranged in parallel to the motor shaft 25. In this embodiment, the intermediate shaft 41 is arranged forward of the motor shaft 25 and the crank shaft 31. The intermediate shaft 41 is supported to be rotatable around a rotational axis A3 parallel to the rotational axis A2 by two bearings held by the driving-mechanism housing part 112. The intermediate shaft 41 has the second gear 411 on its substantially central portion in the up-down direction, and has the small bevel gear 412 on its upper end portion. The second gear 411 is engaged with the first gear 314 provided under the driven gear 311 of the crank shaft 31.

The large bevel gear 413 is provided on a rear end portion of the sleeve 46 and engaged with the small bevel gear 412 provided on the upper end portion of the intermediate shaft 41. In this embodiment, the reduction gear mechanism of the rotation transmitting mechanism 40 reduces the rotation speeds of the motor shaft 25, the intermediate shaft 4, the crank shaft 31 and the sleeve 46 (the tool holder 60) in this order.

The rotary hammer 1 of this embodiment is configured such that either one of two modes: (i) a rotary hammer mode (hammering with rotation mode); and (ii) a hammer mode (hammering only mode), is selected in response to user's manipulation of a mode changing knob 391. In the rotary hammer mode, the motion converting mechanism 30 and the rotation transmitting mechanism 40 are driven, so that hammering motion and rotating motion are produced. In the hammer mode, only the motion converting mechanism 30 is driven, so that only hammering motion is produced.

The tool holder 60 is now described in detail. The tool accessory 18 that is removably coupled to the tool holder 60 is first described. The tool accessory 18 is also referred to as a bit. The tool accessory 18 has a shank 181 (see FIG. 1) that is configured to be coupled to the tool holder 60. The shank 181 has circular arc grooves 182 and rectangular grooves 183 that are recessed toward a center axis A4 of the tool accessory 18, as shown in sectional view of FIG. 4. The circular arc grooves 182 and the rectangular grooves 183 linearly extend parallel to the center axis A4. In this embodiment, the tool accessory 18 has two circular arc grooves 182 symmetrical to the center axis A4 and three rectangular grooves 183 arranged at prescribed intervals in a circumferential direction around the center axis A4. The center axis A4 of the tool accessory 18, when coupled to the tool holder 60, substantially coincides with the driving axis A1.

Figure 3:
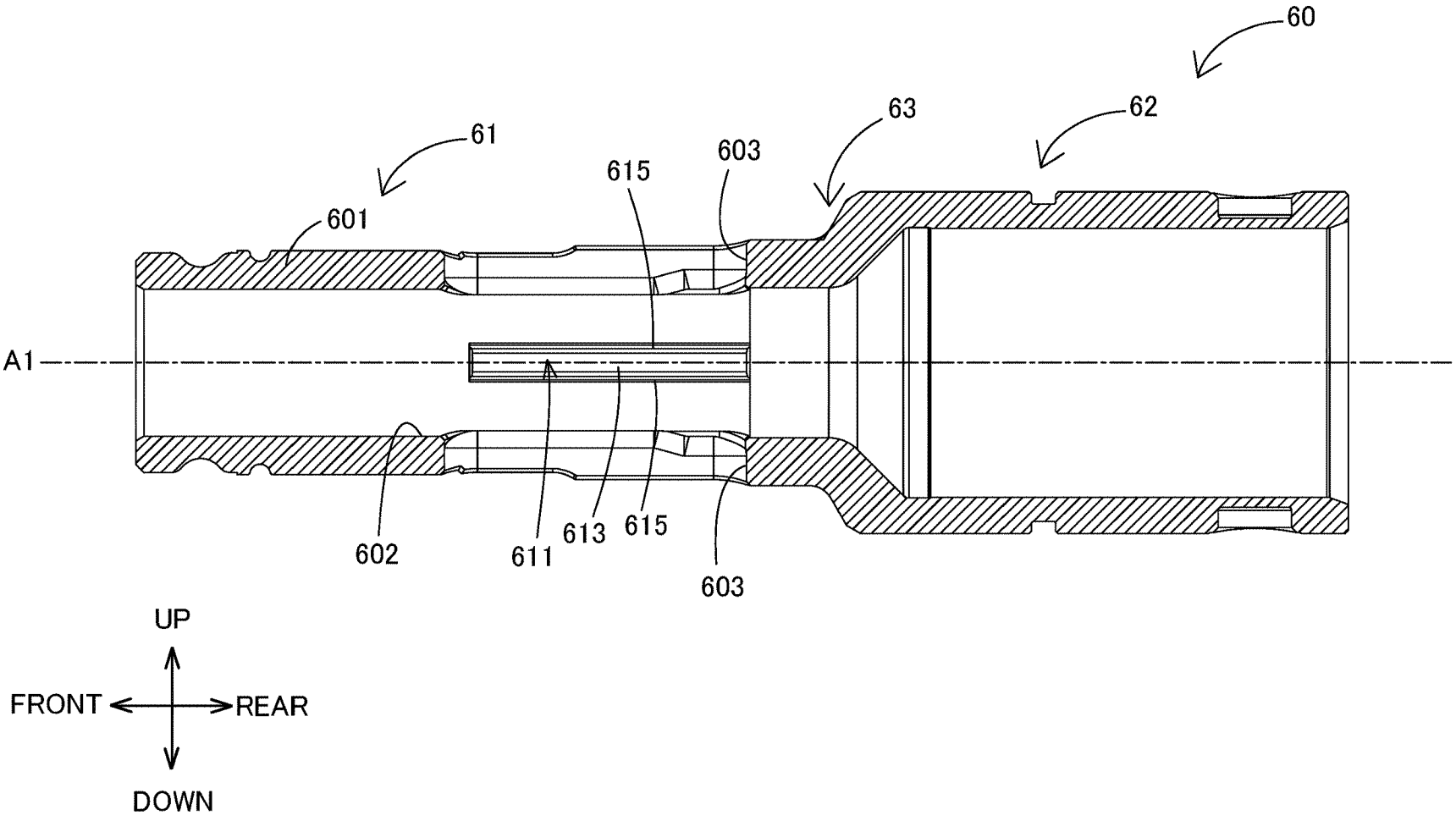
FIG. 3 is a sectional view of a tool holder 60.
Figure 4:
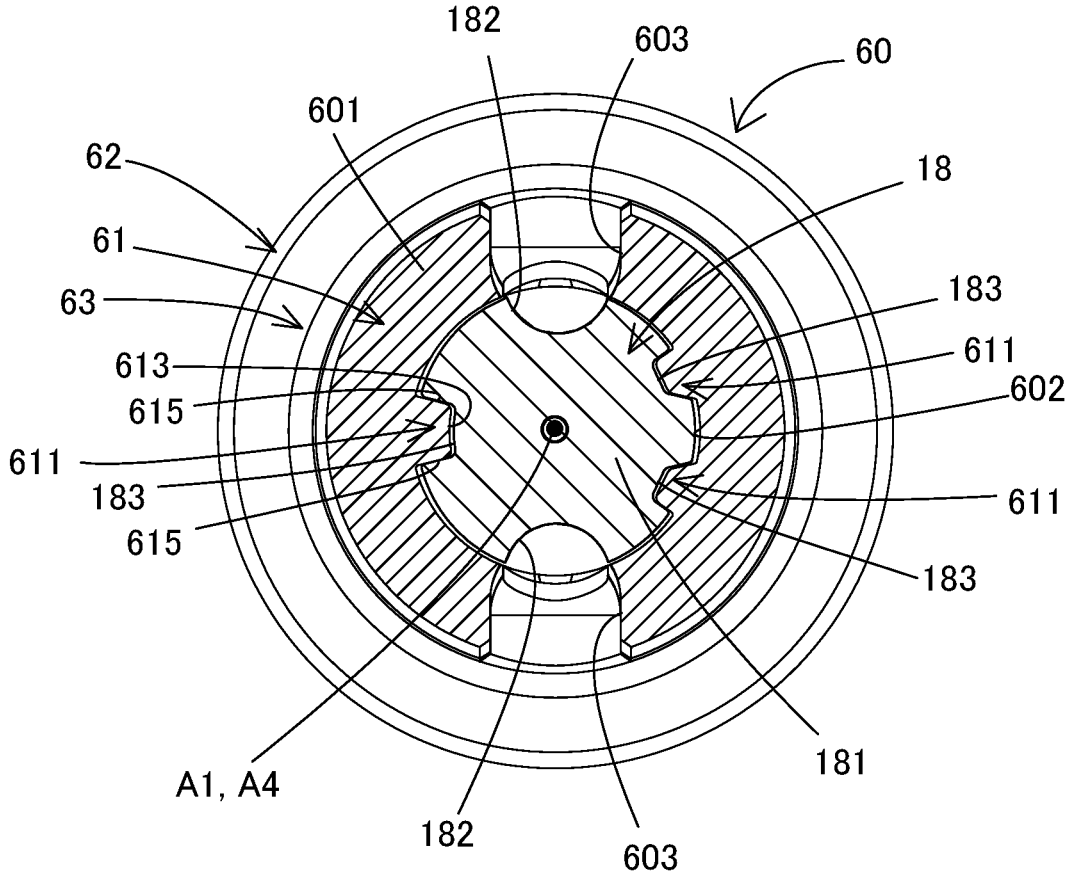
FIG. 4 is a sectional view taken along line IV-IV in FIG. 1, showing the tool holder 60 and the tool accessory 18.
Figure 4:
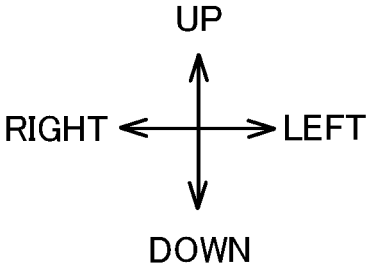

As described above, the tool holder 60 is housed within a front portion of the driving-mechanism housing part 112. As shown in FIGS. 3 and 4, the tool holder 60 is a tubular member extending along the driving axis A1. The tool accessory 18 is partially housed (held or received) inside of the tubular wall 601 of the tool holder 60. Specifically, the shank 181 of the tool accessory 18 is inserted into the inside of the tubular wall 601 from the front.

In this embodiment, the tubular wall 601 of the tool holder 60 has a small diameter part 61 and a large diameter part 62 that are respectively formed in front and rear portions in the front-rear direction, and a stepped part 63 connecting the small diameter part 61 and the large diameter part 62. The large diameter part 62 has an inner diameter and an outer diameter that are respectively larger than the inner diameter and the outer diameter of the small diameter part 61. The tubular wall 601 of the tool holder 60 has a substantially uniform thickness in the front-rear direction. The large diameter part 62 is fitted into a front portion of the sleeve 46 and fixed to the sleeve 46 with pins 461 (see FIG. 2). Thus, the tool holder 60 is rotatable around the driving axis A1 relative to the body housing 11 integrally with the sleeve 46. A portion of the striking mechanism 36 (specifically, the impact bolt 362) is housed partly within a front portion of the sleeve 46 (the cylinder 35) and partly within the large diameter part 62. The impact bolt 362 is slidable in the front-rear direction within the large diameter part 62.

The tool holder 60 has two slots 603 formed through the tubular wall 601 in the radial direction and extending linearly in the driving axis A1 direction. The slots 603 are arranged in symmetry to the driving axis A1. In this embodiment, the slots 603 are formed in a rear portion of the small diameter part 61. Stopper 71 are normally engaged with the slots 603 to restrict slipping off of the tool accessory 18 inserted into the tool holder 60 and to conditionally allow removal of the tool accessory 18 (see FIGS. 1 and 2). The stoppers 71 are movable in the driving axis A1 direction within the slots 603. Although not described in detail, a biasing mechanism is provided around the tool holder 60 to bias the stoppers 71 toward the driving axis A1. The biasing mechanism prevents the tool accessory 18 from slipping off from the tool holder 60 (the inside of the tubular wall 601).

A plurality of protruding parts (projections) 611 are formed in prescribed positions in the circumferential direction in a rear portion of the small diameter part 61. The protruding parts 611 protrude radially inward from an inner peripheral surface 602 of the tubular wall 601. The protruding parts 611 linearly extend in the driving axis A1 direction. The protruding parts 611 are arranged in positions corresponding to the three rectangular grooves 183 in the circumferential direction. Each of the protruding parts 611 has a first face 613 that extends the circumferential direction around the driving axis A1, and second faces 615 that crosses (intersects) a direction crossing the circumferential direction.

When the user inserts the tool accessory 18 into the tool holder 60 and positions the protruding parts 611 of the tool holder 60 to be fitted in the rectangular grooves 183 of the tool accessory 18, the stoppers 71 is moved radially outward while being pushed by a rear end portion of the shank 181 and then engages with the circular arc grooves 182 of the shank 181 via the slots 603 of the tool holder 60. When the rotation transmitting mechanism 40 transmits rotating power of the motor 2 to the sleeve 46 and the tool holder 60 and rotates the sleeve 46 and the tool holder 60 around the driving axis A1, the protruding parts 611 abut on (contact) the rectangular grooves 183 of the tool accessory 18 and transmit the rotating power of the motor 2 to the tool accessory 18. More specifically, the second faces 615 of the protruding parts 611 abut on (contact) side faces of the rectangular grooves 183 of the tool accessory 18 and transmit the rotating power of the motor 2 to the tool accessory 18. The protruding parts 611 thus serve as a rotation transmitting part for transmitting the rotating power of the motor 2 to the tool accessory 18. The second faces 615 also serve as a torque transmitting part (torque transmitting face) for transmitting torque to the tool accessory 18.

The material of the tool holder 60 and the coating layer formed on the tool holder 60 are now described. The tool holder 60 is made of a material (steel) containing iron as a major component and carbon. The tool holder 60 is formed by forging the steel. In this embodiment, the content of carbon is not less than 0.04 mass % (hereinafter simply indicated as % (percent)) and not greater than 0.25%. Examples of the material of the tool holder 60 may include carbon steel for machine structural purposes (e.g., S10C, S15C, S17C (Japanese Industrial Standard; JIS)) and chrome molybdenum steel (e.g., SCM415 (Japanese Industrial Standard; JIS)).

The hard coating layer is formed on a surface of the tool holder 60. The hard coating layer is a layer of carbide of a group 5 element of the periodic table. Example of the group 5 element include vanadium (V), niobium (Nb), tantalum (Ta) and dubnium (db). In this embodiment, a vanadium carbide (VC) layer is formed, as the hard coating layer, on the surface of the tool holder 60.

The hard coating layer is formed by subjecting an intermediate product of the tool holder 60, which is formed by forging the above-described steel into the shape of the tool holder 60, to surface hardening. For example, TD process (Toyota diffusion coating process) may be employed for the surface hardening. In the TD process, a material to be treated is immersed and held in a molten salt bath of about 850 to 1050° C. to form a carbide layer on a surface of the material. The molten (fused) salt contains boric acid (borate, borax) as a major component and a target element for forming a carbide. An extremely hard coating layer having a hardness of about 2000 to 3800 (Hv), for example, is formed by the TD process.

The tool holder 60 of this embodiment is formed such that the inner peripheral surface 602 of the large diameter part 62 has a lower surface roughness than surfaces of the other portions (i.e., surfaces of the small diameter part 61 and the stepped part 63) of the tool holder 60. In this embodiment, after the intermediate product is subjected to the TD process, the inner peripheral surface 602 of the large diameter part 62 is polished to form the finished tool holder 60.

The above-described rotary hammer 1 of the first embodiment has the tool holder 60 having a VC layer. This VC layer can suppress wear of the protruding parts 611 that transmit rotation to the rectangular grooves 183 of the tool accessory 18, thus enhancing the durability of the tool holder 60 and the rotary hammer 1.

Further, the tool holder 60 slidably holds (houses) the impact bolt 362 that serves as a striking element for striking the tool accessory 18, in addition to the tool accessory 18. Thus, the parts count of the rotary hammer 1 can be reduced as compared with a configuration in which a member for holding the impact bolt 362 is separately provided.

The tool holder 60 is basically a forged product so that the degree of freedom in shape of the tool holder 60 is enhanced. Further, the tool holder 60 is made of steel containing carbon of not less than 0.04% and not greater than 0.25%, and thus suitable as a forged product. The tool holder 60 further has a hard coating layer formed by subjecting the forged product made of steel containing carbon of not less than 0.04% and not greater than 0.25% to a TD process using a group 5 element of the periodic table. Thus, the rotary hammer 1 is provided with the tool holder 60 having wear resistance and toughness high enough to withstand a load applied during operation.

Further, according to this embodiment, the tool holder 60 and the rotary hammer 1 are enhanced in durability, and the rotary hammer 1 can be provided in which the rotational axis A2 of the motor 2 is arranged to cross the driving axis A1.

Further, the inner peripheral surface 602 of the large diameter part 62 of the tool holder 60 has a lower surface roughness than the other portions of the tool holder 60. Therefore, air tightness between the impact bolt 362 and the inner peripheral surface 602 of the tubular wall 601 in the large diameter part 62 of the tool holder 60 can be effectively kept by the elastic member 368.

It is noted that an outer peripheral surface of the large diameter part 62 may also have a lower surface roughness than the surfaces of the other portions of the tool holder 60, excluding the inner peripheral surface 602 of the large diameter part 62. This modification allows fitting of the tool holder 60 into the sleeve 46 with high accuracy and secures the accuracy of assembling the tool holder 60 to the sleeve 46.

Second Embodiment

A rotary hammer 1A is now described as a representative example of a power tool having a rotary hammer mechanism according to a second embodiment with reference to FIGS. 5 to 8. In the following description, components identical to those of the rotary hammer 1 are given like numerals and are not described. Like the rotary hammer 1 of the first embodiment, the rotary hammer 1A is configured to produce (provide) hammering motion and rotating motion. The hammering motion is to linearly drive a tool accessory 18A along a driving axis A5, and rotating motion is to rotationally drive the tool accessory 18A around the driving axis A5. The driving axis A5 is also referred to as a hammering axis (striking axis, impact axis).

Figure 5:
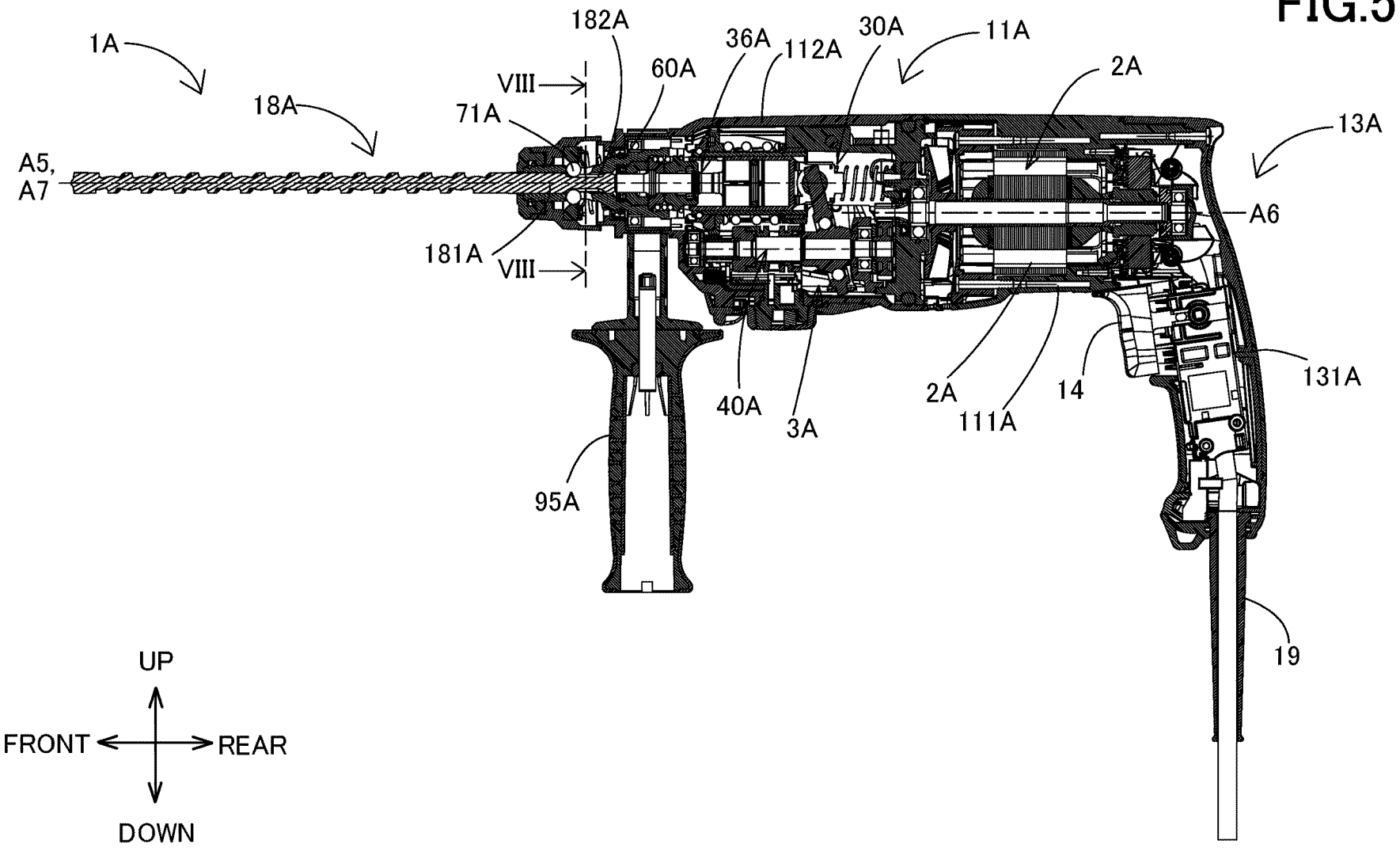
FIG. 5 is a sectional view of a rotary hammer 1A with a tool accessory 18A attached thereto.
Figure 6:
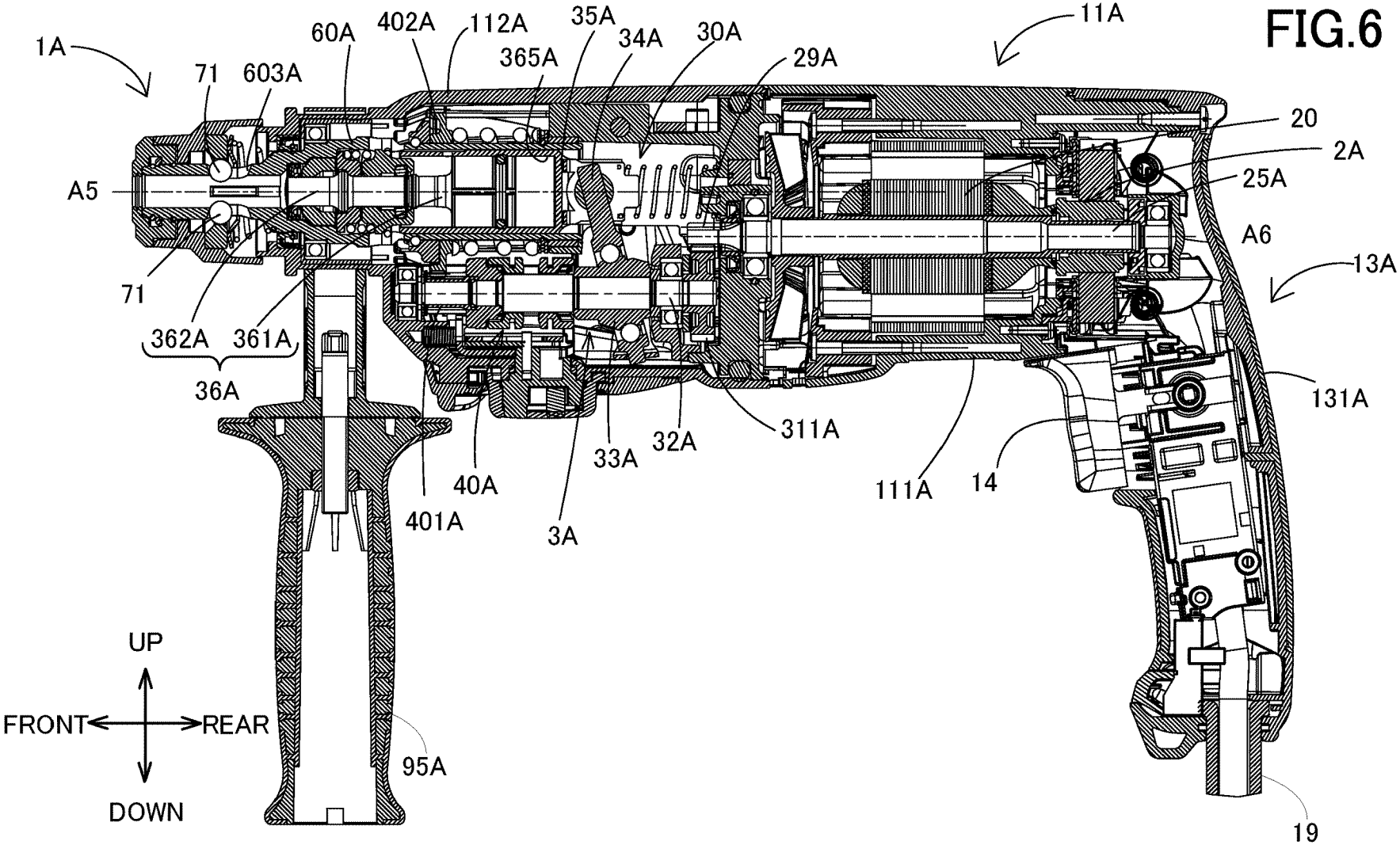
FIG. 6 is a sectional view for illustrating the structures of elements disposed within the rotary hammer 1A.
Figure 7:
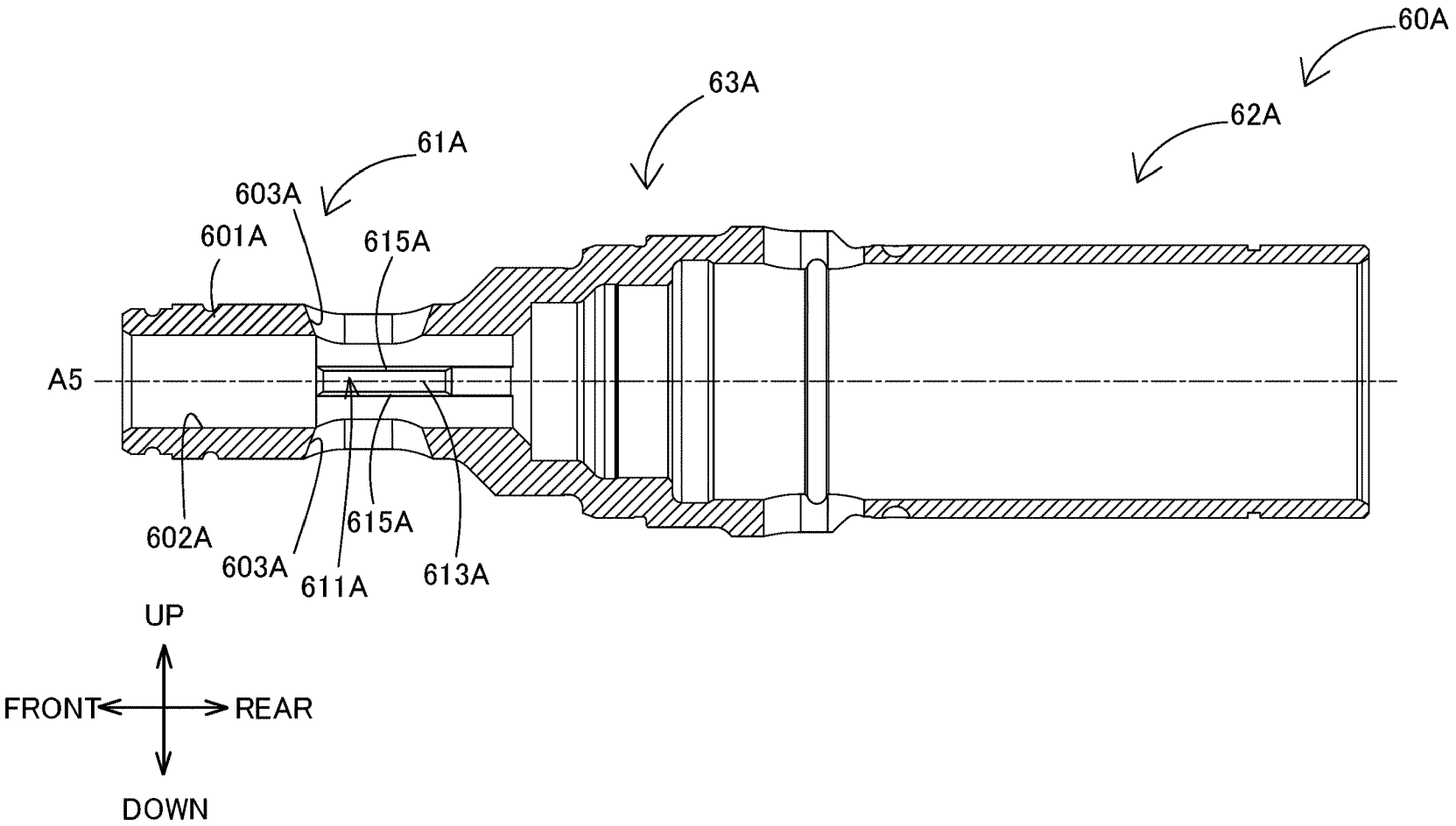
FIG. 7 is a sectional view of a tool holder 60A.
Figure 8:
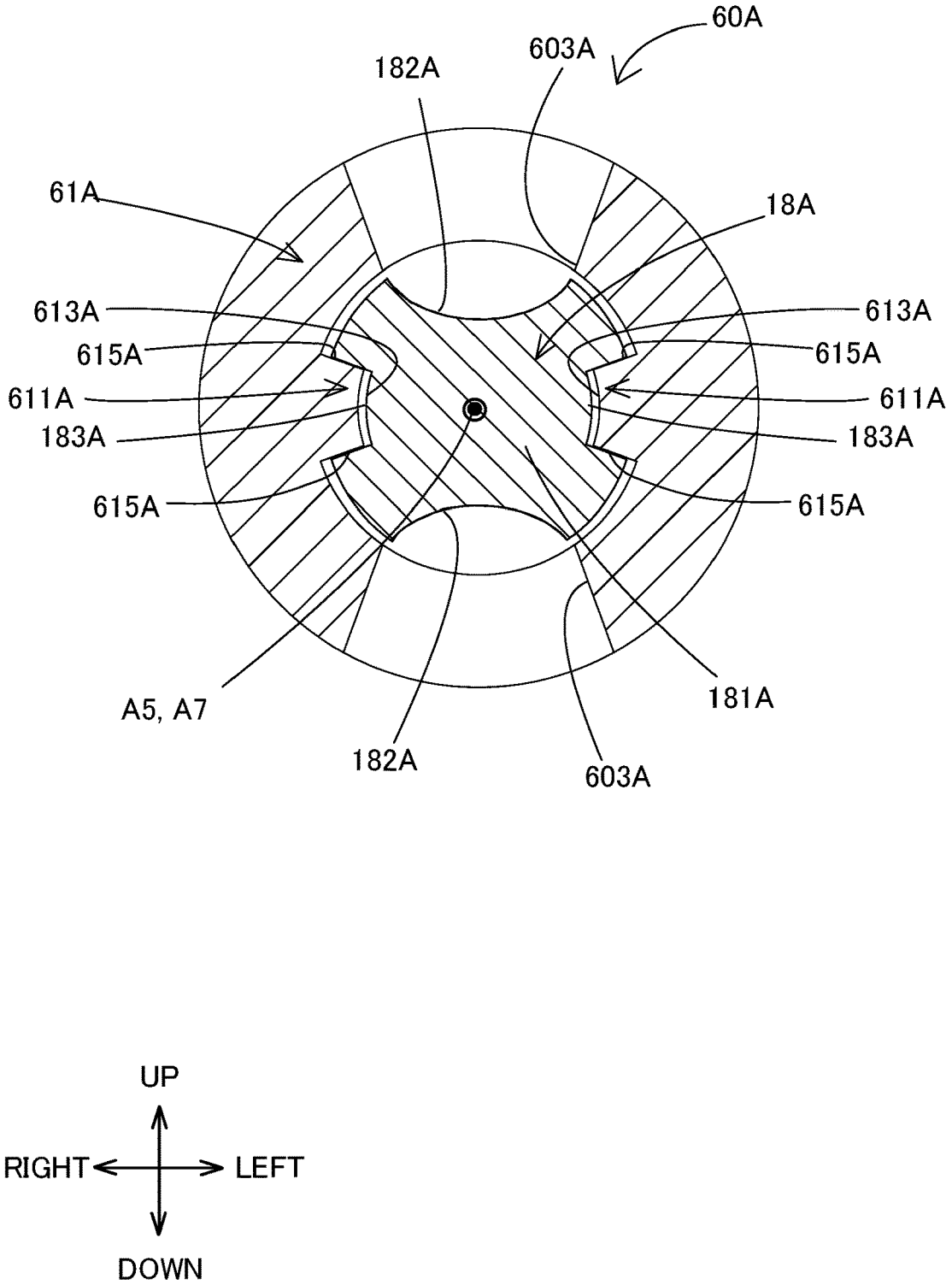
FIG. 8 is a sectional view taken along line VIII-VIII in FIG. 5, showing the tool holder 60A and the tool accessory 18A.

An outer shell of the rotary hammer 1A is mainly formed by a body housing 11A and a handle 13A. As shown in FIGS. 5 and 6, the body housing 11A has an elongate shape extending along the driving axis A5. A tool holder 60A is provided within one end portion of the body housing 11A in the driving axis A5 direction and configured to removably hold the tool accessory 18A. This one end portion of the body housing 11A has a tubular shape, and an auxiliary handle (side handle) 95A is removably attached onto an outer periphery of the end portion. The handle 13A has a grip part 131A to be held by the user. The grip part 131A extends in a direction crossing (specifically, substantially orthogonal to) the driving axis A5 and protrudes in a cantilever form in a direction away from the driving axis A5 relative to the body housing 11A.

In the following description, for convenience sake, the extending direction of the driving axis A5 (the driving axis A5 direction) is defined as a front-rear direction of the rotary hammer 1A. In the front-rear direction, the side of one end portion of the rotary hammer 1A in which the tool holder 60A is provided is defined as the front of the rotary hammer 1A and the opposite side is defined as the rear of the rotary hammer 1A. A direction orthogonal to the driving axis A5 and corresponding to the extending direction of the grip part 131A is defined as an up-down direction. In the up-down direction, the side of a base end of the grip part 131A is defined as an upper side, and the side of a protruding end of the grip part 131A is defined as a lower side. A power cable 19 for supplying power from an external power source to a motor 2A is arranged on a lower end of the grip part 131A. A trigger 14 is provided in a front portion of the grip part 131A and configured to be manually depressed by the user to drive the motor 2A.

The body housing 11 includes a motor housing part 111A and a driving-mechanism housing part 112A.

As shown in FIGS. 5 and 6, the motor housing part 111A houses a motor 2A. The motor 2A has a motor body 20 including a stator and a rotor, and a motor shaft 25A extending from the rotor. In this embodiment, a rotational axis A6 of the motor shaft 25A is arranged in parallel to the driving axis A5 and extends in the front-rear direction. Front and rear end portions of the motor shaft 25A are rotatably supported by bearings held by the motor housing part 111A. A driving gear 29A is on a front-end portion of the motor shaft 25A.

The driving-mechanism housing part 112A has an elongate tubular shape extending in the front-rear direction along the driving axis A5 as a whole and houses a driving mechanism (rotary hammer mechanism) 3A. The tubular tool holder 60A is housed in a front portion of the driving-mechanism housing part 112A. The tool holder 60A is supported by the body housing 11A so as to be rotatable around the driving axis A5 relative to the body housing 11A. Like the tool holder 60 of the first embodiment, the tool holder 60A has a hard coating layer and has excellent wear resistance. The tool holder 60A will be described in detail below.

The driving mechanism 3A includes a motion converting mechanism 30A, a striking mechanism (hammering mechanism) 36A and a rotation transmitting mechanism 40A.

The motion converting mechanism 30A is configured to convert rotation of the motor shaft 25A into linear motion and transmit it to the striking mechanism 36A. In this embodiment, as shown in FIG. 6, the motion converting mechanism 30A includes an intermediate shaft 32A, a rotary body 33A, an oscillating member 34A and a piston cylinder 35A. The intermediate shaft 32A is arranged to extend in the front-rear direction in parallel to the motor shaft 25A. The intermediate shaft 32A is rotatably supported by two bearings held by the body housing 11A. The rotary body 33A is fitted onto an outer periphery of the intermediate shaft 32A so as to be rotatable together with the intermediate shaft 32A. The oscillating member 34A is fitted onto an outer periphery of the rotary body 33A and oscillated in the front-rear direction as the rotary body 33A rotates. The piston cylinder 35A has a bottomed cylindrical shape and is held within the tool holder 60A so as to be slidable in the front-rear direction. The piston cylinder 35A is reciprocated in the front-rear direction as the oscillating member 34A is oscillated.

Like in the first embodiment, the striking mechanism 36A includes a striker 361A and an impact bolt 362A. In this embodiment, the striking mechanism 36A is housed within the tool holder 60A. The striker 361A is disposed to be slidable in the front-rear direction within the piston cylinder 35A housed in the tool holder 60A. An air chamber 365A is formed between the striker 361A and the piston cylinder 35A. The striker 361A is linearly moved in response to air pressure fluctuations in air chamber 365A. The impact bolt 362A is configured to transmit kinetic energy of the striker 361A to the tool accessory 18A.

Like in the first embodiment, when the motor 2A is driven and the piston cylinder 35A is moved forward, air in the air chamber 365A is compressed and its internal pressure increases. In this embodiment, the piston cylinder 35A also serves as a so-called piston. The striker 361A is pushed forward at high speed by action of the air spring and collides with the impact bolt 362A, thereby transmitting its kinetic energy to the tool accessory 18A. As a result, the tool accessory 18A is linearly driven along the driving axis A5 and strikes a workpiece. On the other hand, when the piston cylinder 35A is moved rearward, air of the air chamber 365A expands so that the internal pressure decreases and the striker 361A is retracted rearward. The rotary hammer 1A produces (provides) hammering motion by causing the motion converting mechanism 30A and the striking mechanism 36A to repeat these operations.

The rotation transmitting mechanism 40A is configured to transmit torque of the motor shaft 25A to the tool holder 60A. Like in the first embodiment, the rotation transmitting mechanism 40A is configured as a reduction gear mechanism including a plurality of gears. The gears include a driving gear 29A, a driven gear 311A, a first gear 401A and a second gear 402A. The driving gear 29A is provided on a front end of the motor shaft 25A. The driven gear 311A is provided on a rear end portion of the intermediate shaft 32A and engaged with the driving gear 29A. The first gear 401A is provided on a front-end portion of the intermediate shaft 32A. The second gear 402A is provided on an outer periphery of the tool holder 60A and engaged with the first gear 401A. In this embodiment, the reduction gear mechanism of the rotation transmitting mechanism 40A reduces the rotation speeds of the motor shaft 25A, the intermediate shaft 32A and the tool holder 60A in this order.

The rotary hammer 1A of this embodiment is configured such that either one of three modes: (i) a rotary hammer mode (hammering with rotation mode); (ii) a hammer mode (hammering only mode); and (iii) a rotary mode (rotation only mode). The rotary hammer mode and the hammer mode are similar to those of the first embodiment. In the rotary mode, power transmission in the motion converting mechanism 30A is interrupted and only the rotation transmitting mechanism 40A is driven, so that only rotary motion is produced.

The tool holder 60A is now described in detail. The tool accessory 18A that is removably coupled to the tool holder 60A is first described. A shank 181A of the tool accessory 18A has circular arc grooves 182A and rectangular grooves 183A that are recessed toward a center axis A7 of the tool accessory 18A, as shown in sectional view of FIG. 8. The circular arc grooves 182A and the rectangular grooves 183A linearly extend parallel to the center axis A7. In this embodiment, the tool accessory 18A has two circular arc grooves 182A symmetrical to the center axis A7 and two rectangular grooves 183A arranged at prescribed intervals in a circumferential direction around the center axis A7. The center axis A7 of the tool accessory 18A, when coupled to the tool holder 60A, substantially coincides with the driving axis A5.

The tool holder 60A is a tubular member extending along the driving axis A5. A tubular wall 601A of the tool holder 60A has a small diameter part 61A and a large diameter part 62A that are respectively formed in front and rear portions of the tool holder 60A in the front-rear direction, and a multi-stepped part 63A connecting the small diameter part 61A and the large diameter part 62A. The large diameter part 62A has an inner diameter and an outer diameter that are respectively larger than the inner diameter and the outer diameter of the small diameter part 61A. An outer periphery of the tool holder 60A is supported by bearings held by the body housing 11A so as to be rotatable around the driving axis A5 relative to the body housing 11A. The tool holder 60A houses the striking mechanism 36A and the piston cylinder 35A in addition to the tool accessory 18A.

Like in the first embodiment, the tool holder 60A has two slots 603A formed through the tubular wall 601A in the radial direction and extending linearly in the driving axis A5 direction. Stoppers 71 are normally engaged with the slots 603A (see FIGS. 5 and 6). Protruding parts (projections) 611A are formed in the small diameter part 61A and protrude radially inward from an inner peripheral surface 602A of the tubular wall 601A. The protruding parts 611A linearly extend in the driving axis A5 direction. The protruding parts 611A are arranged in positions corresponding to the two rectangular grooves 183A in the circumferential direction. Each of the protruding parts 611A has a first face 613A that extends along the circumferential direction around the driving axis A5 and second faces 615A that cross (intersect) the circumferential direction. The tool accessory 18A can be coupled to the tool holder 60A in the same manner as in the first embodiment, and thus this manner is not described.

Like in the first embodiment, when the rotation transmitting mechanism 40A transmits rotating power of the motor 2A to the tool holder 60A and rotates the tool holder 60A, the protruding parts 611A abut on (contact) side faces of the rectangular grooves 183A and transmit the rotating power of the motor 2A to the tool accessory 18A. More specifically, the second faces 615A of the rectangular grooves 183A abut on (contact) the side faces of the rectangular grooves 183A of the tool accessory 18A and transmit the rotating power of the motor 2A to the tool accessory 18A. The protruding parts 611A serve as a rotation transmitting part for transmitting the rotating power of the motor 2A to the tool accessory 18A. The second faces 615A also serve as a torque transmitting part (torque transmitting face) for transmitting torque to the tool accessory 18A.

The material of the tool holder 60A and the coating layer formed on the tool holder 60A are similar to those of the first embodiment. The tool holder 60A is formed by forging a material (steel) containing iron as a major component and carbon. The coating layer is a carbide layer formed of a group 5 element of the periodic table. The coating layer can be formed by the TD process. In this embodiment, the inner peripheral surface 602A of the large diameter part 62A of the tool holder 60A has substantially the same surface roughness as surfaces of the other portions of the tool holder 60A.

Further, according to the above-described second embodiment, like the first embodiment, the tool holder 60A and the rotary hammer 1A are enhanced in durability, and the rotary hammer 1 can be provided in which the rotational axis A6 of the motor 2A is arranged in parallel to the driving axis A5.

Further, the tool holder 60A is configured to house the piston cylinder 35A in addition to the tool accessory 18A. Thus, the tool holder 60A is provided with a plurality of functions including a function of holding the tool accessory 18A and transmitting rotating power and a function of housing the piston cylinder 35A. Further, the parts count (the number of parts/components) of the rotary hammer 1A can be reduced as compared with a configuration in which a member for housing the piston cylinder 35A is separately provided.

<Correspondences>

Correspondences between the features of the above-described embodiments and the features of the present disclosure are as follows. The features of the above-described embodiment are merely exemplary and do not limit the features of the present disclosure.

The rotary hammer 1, 1A is an example of the "power tool having a rotary hammer mechanism".

The tool accessory 18, 18A is an example of the "tool accessory".

The driving axis A1, A5 is an example of the "driving axis".

The tool holder 60, 60A is an example of the "tool holder".

The protruding part 611, 611A and the second face 615, 615A are an example of the "rotation transmitting part".

The tubular wall 601, 601A is an example of the "tubular wall".

The protruding part 611, 611A is an example of the "protruding part".

The impact bolt 362, 362A is an example of the "striking element".

The piston cylinder 35A is an example of the "piston".

The large diameter part 62 is an example of the "portion of the tubular wall that houses the striking element".

The inner peripheral surface 602, 602A is an example of the "inner peripheral surface". The motor 2, 2A is an example of the "motor".

The rotational axis A2, A6 is an example of the "rotational axis".

Other Embodiments

The tool holder 60, 60A may be formed not by forging, but, for example, by casting.

The coating layer of the tool holder 60, 60A may be a layer of carbide of chrome (Cr) instead of carbide of a group 5 element of the periodic table. The chromium carbide layer may be formed by the TD process. In this case, the durability of the tool holder 60, 60A can be enhanced like in the above-described embodiments.

In the first embodiment, the inner peripheral surface 602 of a housing part (the large diameter part 62) for housing the impact bolt 362 may have the same surface roughness as surfaces of the other portions of the tool holder 60.

The coating layer may be formed not by the TD process, but by other processing, such as PVD (physical vapor deposition) and CVD (chemical vapor deposition).

The coating layer need not be formed entirely over the tool holder 60, 60A, and may only be formed on at least one portion that is configured to transmit rotation to the tool accessory 18, 18A. For example, the coating layer may be formed only on the protruding parts 611, 611A or on the second faces 615, 615A of the protruding parts 611, 611A.

The rotational axis A2, A6 of the motor 2, 2A need not be arranged in parallel or orthogonally to the driving axis A1, A5 of the tool holder 60, 60A, and may cross (intersect) the driving axis A1, A5 at a prescribed angle.

The present disclosure is not limited to any of the above-described embodiments but may be implemented by a diversity of configurations without departing from the scope of the disclosure. For example, the technical features in any of the embodiments that correspond to the technical features in the aspects described in "Summary" herein may be replaced or combined appropriately, in order to solve part or all of the problems described above or in order to achieve part or all of the advantageous effects described above. Any of the technical features may be omitted appropriately unless the technical feature is described as essential in the description hereof.

DESCRIPTION OF THE REFERENCE NUMERALS

1: rotary hammer, 1A: rotary hammer, 2: motor, 2A: motor, 3: driving mechanism, 3A: driving mechanism, 11: body housing, 11A: body housing, 13: handle, 13A: handle, 14: trigger, 18: tool accessory, 18A: tool accessory, 19: power cable, 20: motor body, 25: motor shaft, 25A: motor shaft, 29: driving gear, 29A: driving gear, 30: motion converting mechanism, 30A: motion converting mechanism, 31: crank shaft, 32: connecting rod, 32A: intermediate shaft, 33: piston, 33A: rotary body, 34A: oscillating member, 35: cylinder, 35A: piston cylinder, 36: striking mechanism, 36A: striking mechanism, 40: rotation transmitting mechanism, 40A: rotation transmitting mechanism, 41: intermediate shaft, 46: sleeve, 60: tool holder, 60A: tool holder, 61: small diameter part, 61A: small diameter part, 62: large diameter part, 62A: large diameter part, 63: stepped part, 63A: stepped part, 71: stopper, 95A: auxiliary handle, 111: motor housing part, 111A: motor housing part, 112: driving-mechanism housing part, 112A: driving-mechanism housing part, 131: grip part, 131A: grip part, 181: shank, 181A: shank, 182: circular arc groove, 182A: circular arc groove, 183: rectangular groove, 183A: rectangular groove, 311: driven gear, 311A: driven gear, 312: crank pin, 314: first gear, 361: striker, 361A: striker, 362: impact bolt, 362A: impact bolt, 365: air chamber, 365A: air chamber, 368: elastic member, 391: mode changing knob, 401A: first gear, 402A: second gear, 411: second gear, 412: small bevel gear, 413: large bevel gear, 461: pin, 601: tubular wall, 601A: tubular wall, 602: inner peripheral wall, 602A: inner peripheral wall, 603: slot, 603A: slot, 611: protruding part, 611A: protruding part, 613: first face, 613A: first face, 615: second face, 615A: second face, A1: driving axis, A2: rotational axis, A3: rotational axis, A4: center axis, A5: driving axis, A6: rotational axis, A7: center axis

The invention claimed is:

1. A power tool comprising:

a rotary hammer mechanism configured to produce (i) hammering motion for driving a tool accessory along a driving axis and (ii) rotating motion for rotating the tool accessory around the driving axis;

a striking element configured to transmit the hammering motion to the tool accessory by moving along the driving axis and colliding with the tool accessory; and a tool holder having (i) a tubular wall (a) with a longitudinal central axis that is co-axial with the driving axis and (b) configured to removably hold the tool accessory and (ii) a rotation transmitting part configured to transmit rotating power to the tool accessory, wherein a layer of carbide of a group 5 element of a periodic table is on the rotation transmitting part, the tubular wall and the rotation transmitting part are of a same material and one-piece, the tubular wall includes (i) a large diameter part configured to slidably house at least a portion of the striking element and (ii) a small diameter part having a smaller inner diameter than the large diameter part, the large diameter part and the small diameter part do not overlap in radial and circumferential directions, the rotation transmitting part is in the small diameter part, and an inner peripheral surface of the large diameter part has a lower surface roughness than an inner peripheral surface of the small diameter part.

2. The power tool as defined in claim 1, wherein the layer is a vanadium carbide (VC) layer.

3. The power tool as defined in claim 1, wherein the tool holder is a forged product.

4. The power tool as defined in claim 1, wherein:

the rotation transmitting part comprises a plurality of protruding parts protruding radially inward from an inner peripheral surface of the tubular wall.

5. The power tool as defined in claim 1, further comprising:

a piston configured to move the striking element along the driving axis, wherein the tubular wall is configured to at least partly house the piston on a side of the striking element opposite to the tool accessory on the driving axis.

6. The power tool as defined in claim 1, wherein the tool holder is made of steel containing carbon of not less than 0.04 mass % and not greater than 0.25 mass %.

7. The power tool as defined in claim 1, further comprising:

a motor configured to generate the rotating power, wherein a rotational axis of the motor crosses the driving axis.

8. The power tool as defined in claim 1, further comprising:

a motor configured to generate the rotating power, wherein a rotational axis of the motor is parallel to the driving axis.

9. The power tool as defined in claim 2, wherein:

the rotation transmitting part comprises a plurality of protruding parts protruding radially inward from an inner peripheral surface of the tubular wall.

10. The power tool as defined in claim 9, further comprising:

a piston configured to move the striking element along the driving axis, wherein the tubular wall is configured to at least partly house the piston on a side of the striking element opposite to the tool accessory on the driving axis.

11. The power tool as defined in claim 10, wherein the tool holder is made of steel containing carbon of not less than 0.04 mass % and not greater than 0.25 mass %.

12. The power tool as defined in claim 11, wherein the tool holder is a forged product.

13. The power tool as defined in claim 2, wherein the tool holder is made of steel containing carbon of not less than 0.04 mass % and not greater than 0.25 mass %.

14. The power tool as defined in claim 1, wherein the layer of carbide has a hardness of between 2000 HV and 3800 HV.

* * * * *